United States Patent [19]

Amtmann et al.

[11] 4,231,626

[45] Nov. 4, 1980

[54] STORAGE SYSTEM

[75] Inventors: James S. Amtmann, Avon; Louis G. Bobrowski, Berlin, both of Conn.

[73] Assignee: The Stanley Works, New Britain, Conn.

[21] Appl. No.: 11,487

[22] Filed: Feb. 12, 1979

[51] Int. Cl.[3] ..... A47B 77/00; A47B 87/00

[52] U.S. Cl. ..... 312/350; 312/108; 312/245; 312/320

[58] Field of Search ..... 312/108, 111, 234.1–234.5, 312/242, 245, 330, 209, 350; 206/387

[56] References Cited

U.S. PATENT DOCUMENTS

| | | | |
|---|---|---|---|
| 2,237,176 | 4/1941 | Dorman | 312/107 |
| 2,800,380 | 7/1957 | Baker | 312/320 |
| 2,853,350 | 9/1958 | Mandel | 312/107 |
| 2,998,128 | 8/1961 | Larsen | 312/234.1 |
| 3,133,771 | 5/1964 | Dorman | 312/107 |
| 3,346,318 | 10/1967 | Propst | 312/198 |
| 3,529,878 | 9/1970 | Blowers | 312/107 |
| 3,606,506 | 9/1971 | Ungaro | 312/107 |
| 3,738,723 | 6/1973 | Rudolph et al. | 312/111 |
| 3,743,372 | 7/1973 | Ruggerone | 312/107 |

OTHER PUBLICATIONS

Publication, Promotional Lit. of Schneider & Klein Metallworenfabrik.

*Primary Examiner*—Casmir A. Nunberg
*Attorney, Agent, or Firm*—Brumbaugh, Graves, Donohue & Raymond

[57] ABSTRACT

A storage system for items such as screws, nuts, bolts and other hardware parts includes a cabinet and drawers in which the parts are packaged and sold. Cooperating keyways and keys on the cabinet and drawers and the lack of supporting horizontal partitions in the cabinet preclude the use of drawers that are not appropriately formed.

16 Claims, 13 Drawing Figures

STORAGE SYSTEM

BACKGROUND OF THE INVENTION

The invention relates to storage systems for purchased items, for example, screws, nuts, bolts, washers, fasteners and other hardware, and more particularly to a cabinet and drawers for storage, the drawers comprising the individual containers in which the various items are purchased.

In machine shops and home workshops, for example, organizers are known wherein multiple plastic drawers fit into a cabinet of multiple "pigeon-hole" openings. Ordinarily small parts such as screws, nuts, bolts, washers and so on are sorted into various drawers for quick access. In one commercially available system, the drawers are the plastic boxes in which the items are sold and the drawer handles are the tabs from which the boxes are suspended on a display rack. The cabinets are simple rectangular units divided by vertical and horizontal partitions into the pigeon-holes for the drawers. The horizontal dividers define floors to support each inserted box. Of course, the cabinet can accommodate any box of approximately the right size. It is not keyed or constructed to receive only boxes that hold the manufacturer's line of items for which the storage system was designed, and not to hold unauthorized boxes. The cabinet and drawers do not combine to form a unified exclusive marketing arrangement in which a customer completes the system by purchasing the items he needs in the only boxes that can interfit with the cabinet.

Containers for capsules have been proposed that have an outer case into which slides an inner drawer of the container, and the outer case can be affixed to numerous other outer cases of like containers to form a file-like arrangement. How well these would remain together is not clear, particularly if, rather than capsules, heavier hardware items were housed. The inner drawer can be replaced by any similarly sized drawer or box, there being nothing to exclude this replacement. Once the outer cases of these containers have been connected together to form the file-like arrangement, that arrangement, like the previously known organizers first discussed above, is divided by vertical and horizontal partitions, and the horizontal partitions form floors on which any suitably sized box can rest.

In various drawer and cabinet arrangements, cooperating slides on vertical cabinet walls and on drawer side walls guide the drawers in their movement in and out. These are not small storage cabinets for small parts, and the drawers are not the associated boxes in which the parts are retailed. The cooperating slides do not provide a keying means whereby only appropriate boxes can be received in the cabinet openings and employed as drawers therein. Rather, a horizontal floor or projections allow any box of approximately the correct width to rest in the cabinets.

Finally, it has been suggested to form a large carton with side projections to support the carton in a receptacle. The face of this carton opens to permit access so that the carton serves, not as a drawer, but as a shelf. This is described as particularly useful for storing clean linens. The projections on the carton sides are just to provide a means to hold the cartons in place. There is no suggestion of keying the cartons to the receptacles.

BRIEF SUMMARY OF THE INVENTION

According to this invention, boxes, in which various retail items such as wood screws, fasteners, and other hardware items or parts are sold, are drawers keyed for use in a specially constructed cabinet. The drawers and cabinet form a storage system or organizer suitable for shop use. The cabinet has multiple openings for receiving the boxes to serve as drawers. The cabinet and the boxes are equipped with aligning keyways and keys that guide sliding movement of the boxes and that also provide support for only the boxes for which the cabinet was intended.

In particular arrangements described in detail below, each box has an integrally molded flange along each of two sides. The cabinet, a unitary molded structure, has vertical partitions with aligning slots to receive the flanges on the box sides and to support the boxes thereby. The flange on one side of the box is higher than the flange on the other. The slots provided by the cabinet are similarly located. This arrangement provides a keying system that precludes the use of boxes other than those for which the system was intended. The preclusion of other than the specially formed boxes is further assured by the omission of horizontal dividers to define floors in the cabinet. There is nothing to support boxes that do not have the properly located flanges.

The boxes vary in length. To prevent shorter boxes being pushed further back into the cabinet, each opening in the cabinet face that is to receive a box includes a downwardly depending tab that extends slightly into the box and abuts its front wall to act as a stop. The front of each box or drawer is thus located appropriately at the front of the cabinet within easy reach. The stop also prevents accidental removal of the box by engaging a rear wall when the drawer is pulled open. Preferably, integral tabs by which the boxes hang on display racks serve as handles of the drawers when the boxes are placed in the cabinet. Special labeling is provided so that when the boxes are opened, as they must be to be placed in the cabinet, a portion of the label is left on the visible face to identify the contents of the box when it serves as a drawer.

The cabinets are formed to stack one on top of the other so that a relatively large storage system of multiple cabinets can be assembled. For this purpose adhesive, non-slip projections are supplied that support the upper stacked cabinet on the lower. In addition, wall support brackets and adhesive strips for affixing the brackets to the cabinet are supplied to permit the user to mount the cabinet on a wall or upright.

From the foregoing, and from the following detailed description of a preferred embodiment, it will be seen that the storage system according to this invention is an easy and inexpensive to manufacture and assemble cabinet and drawer combination. The boxes that form the drawers serve equally well as display rack containers. The flanges and slots that support the boxes in the cabinet and the elimination of horizontal support members or floors forming the drawer receptacles all contribute to the preclusion of the cabinet's use with boxes other than those for which the cabinet was designed, inasmuch as boxes without the keying flanges cannot be vertically supported in place in the cabinet. The cabinet and box combination thus forms a unique and attractive merchandising system in which completion of the storage unit is an incentive for the purchaser to use the seller's products sold in the boxes adapted to become drawers.

DESCRIPTION OF THE DRAWINGS

The foregoing and further features of the invention will better be understood with reference to the following detailed description of a preferred embodiment and with reference to the attached drawing wherein.

DESCRIPTION OF THE PREFERRED EMBODIMENT

Figure 1:
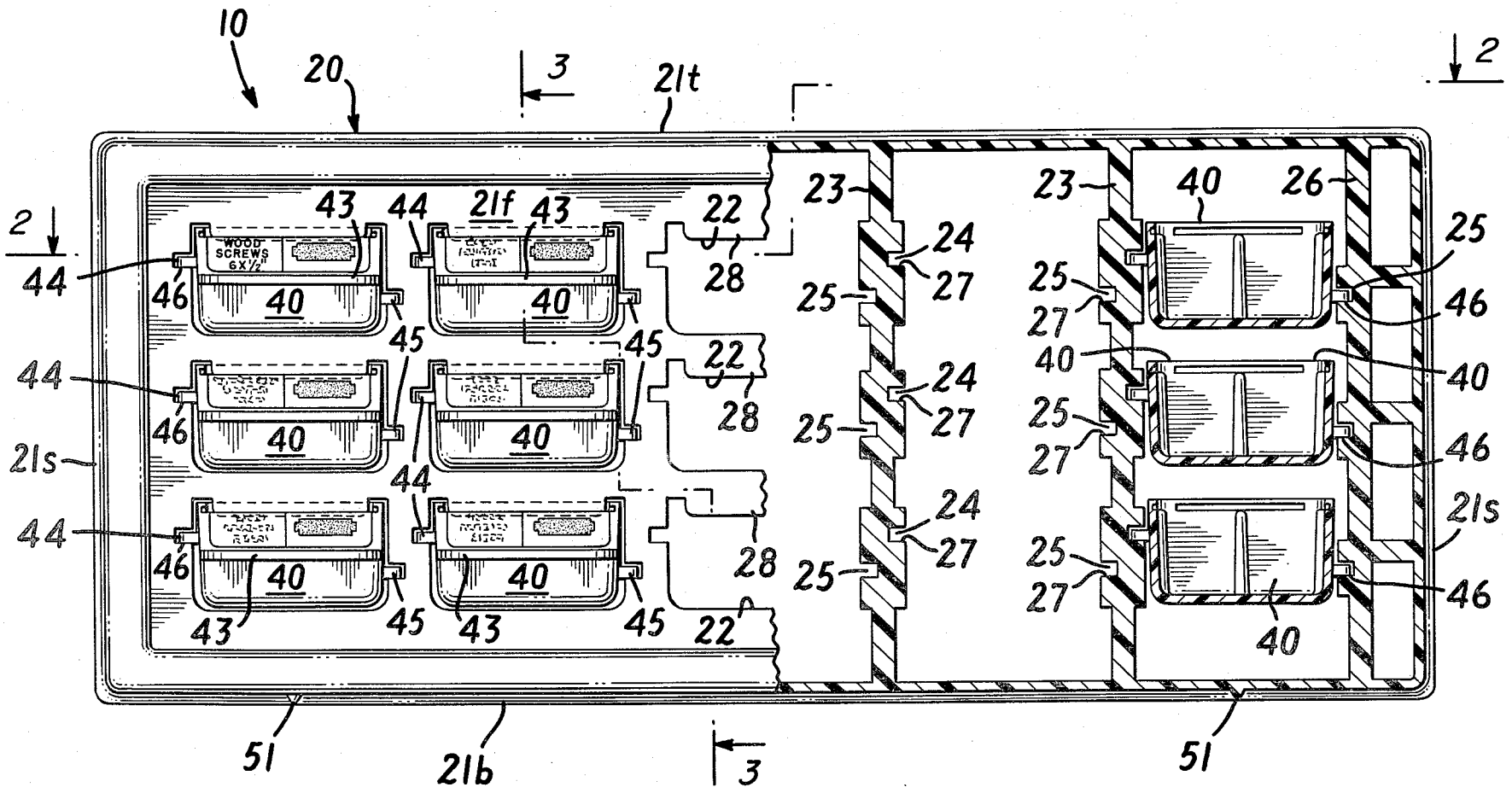
FIG. 1 is a front elevational view, partially in section along the line 1—1 of FIG. 2, showing a cabinet and drawers in a storage system according to the invention.

In FIG. 1 an organizer or storage system 10 is shown that has a cabinet 20 and multiple drawers 40 that are molded plastic boxes. The cabinet 20 is of a molded, one-piece, plastic construction. It has outer surfaces formed by outer top, bottom and side walls, 21*t*, and 21*b* and 21*s*, respectively. It has a frontal face 21*f* with multiple openings 22 defined therein in conformity with the periphery of the drawers 40 received in the cabinet. In its interior, the cabinet 20 has vertical dividing walls 23 extending from top to bottom. No horizontal extending dividers are provided within the cabinets, however.

Each dividing wall 23 has integrally molded slots 24 and 25 extending longitudinally adjacent each drawer site. Interior end walls 26 provide the end slots 24 or 25 for each of the last columns of drawer sites. The slots cooperate with integrally molded flanges 44 and 45 extending longitudinally along the sides of the drawers 40. Downwardly facing supporting surfaces 46 on the flanges rest on upwardly facing supporting surfaces 27 in the slots. Slots 24 and 25 and flanges 44 and 45 cooperate to support the drawers in the cabinet 20 for sliding movement. Moreover, the slots 24 and 25 and flanges 44 and 45 define keying means whereby only the drawers 40 fit into the cabinet. The slots serve as keyways and the flanges serve as keys. Each slot 24 is higher than its counterpart slot 25 and each flange 44 is likewise higher than the associated flange 45 on the other side of the box 40. The difference in height is the same between flanges as between slots. The flanges, then, mate perfectly with the slots, and only a drawer with misaligned flanges like those of the drawers 40 will be supported in the storage system 10. The absence of horizontal dividers or floors in the interior of the cabinet 20 prevents the placement into the cabinet of boxes without appropriately positioned flanges, there being no support for the same.

Figure 2:
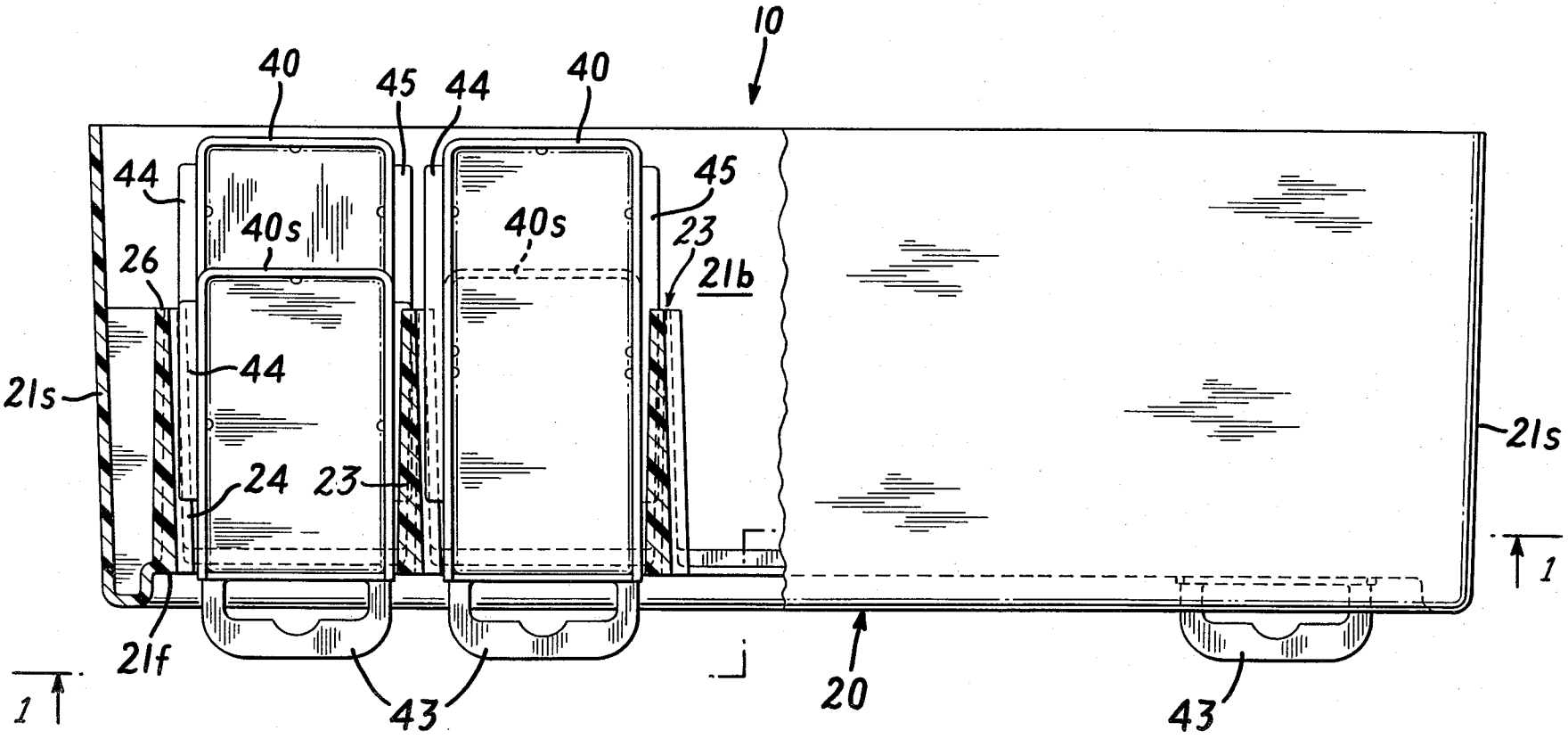
FIG. 2 is a top plan view, partially in section along the line 2—2 of FIG. 1, of the storage system of FIG. 1.
Figure 3:
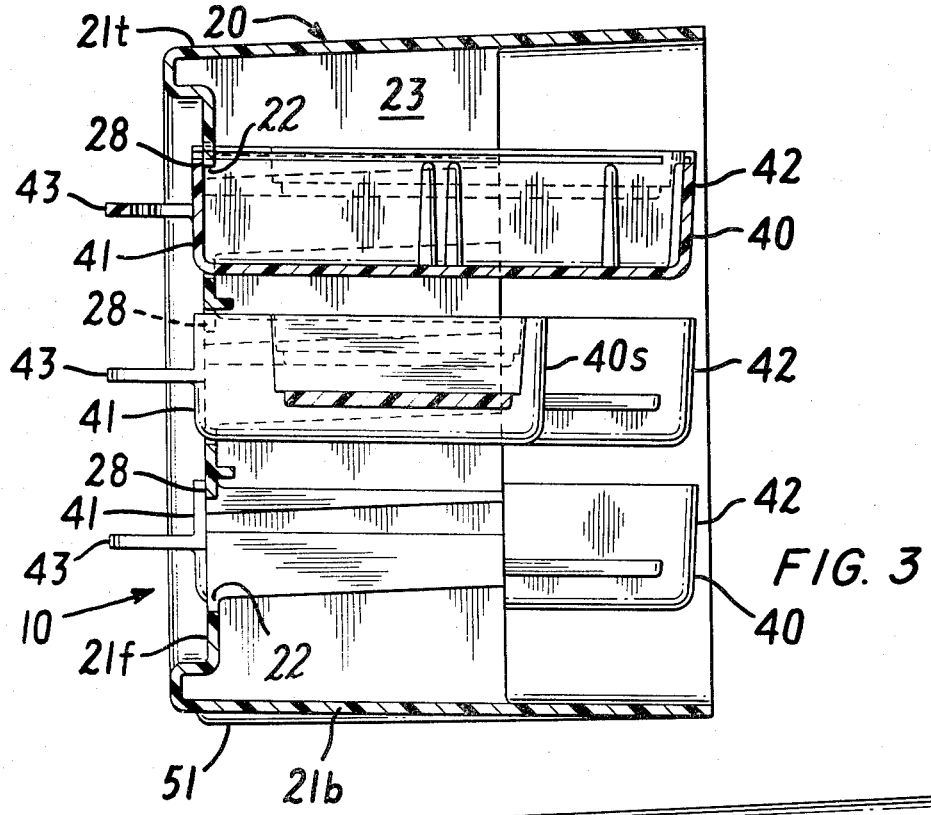
FIG. 3 is a cross-sectional view along the line 3—3 of FIG. 1.

Additional details of the system are apparent from FIGS. 2 and 3. From these figures it will be seen that the drawers 40 vary in size, a shorter drawer bearing the designation 40*s*. Best seen in FIG. 3, the front facial plate 21*f* of the cabinet, at the drawer receiving openings 22, includes a downwardly dependent tab 28 that serves as a stop for the associated drawer. Regardless of the drawer's length, then, the tab or stop 28 engages the interior of a front wall 41 of the drawer so that even the shorter drawer 40*s* does not retreat into the interior of the cabinet 20. All drawers remain accessible, then, and are pulled out by use of the handle 43 integrally formed on the front wall 41. The tabs or stops 28 likewise engage the inside surface of a rear wall 42 of the drawer to prevent accidental removal and spilling.

Figure 8:
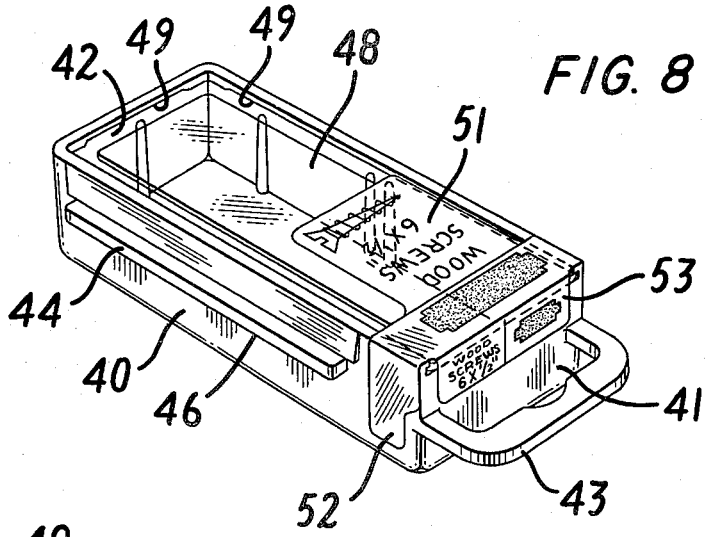
FIG. 8 is an enlarged prospective view of a box suitable for use as a drawer in the storage system of FIGS. 1–7 and having a handle by which the box can be suspended on a display rack.

Each drawer 40 is, in fact, the retail packaging or box of the items stored. Turning to FIG. 8, a closed box is illustrated that forms a drawer 40, and in FIG. 9 an opened box is illustrated that forms a shortened drawer 40*s*. The tabs 43 referred to above in relation to their use as drawer handles serve the dual purpose of supporting the closed boxes when they are hung on display racks at retail outlets.

Each box is provided with a transparent lid 48 or 48*s*. The drawer portions 40 and 40*s* of the boxes are provided with elongate slots 49 into which edges of the lids fit, as shown. FIG. 8 illustrated suitable labeling. A label 51 has its major portion glued to the transparent lid 48. Smaller portions 52 and 53, however, extend from the lid to the body of the box so that, to remove the lid, the label must be broken or severed. The label portion 53 is glued to the front wall 41 of what becomes the drawer 40 so that when the open box is inserted in the cabinet 20 its contents, like those of the drawers around it, are identified.

In use, a box of items is bought, the transparent lid is removed, and with it a major portion of the label. The drawer portion 40 is slipped into place for easy, repeated access. Because of the keyed nature of the boxes and the supporting interior walls, as provided by the mating flanges and slots therein, only boxes intended for use in the system will be accommodated by the cabinet 20. However, it is appreciated that, as a drawer is emptied of its contents, that drawer may be desired for storage of some other part. Blank labels are supplied with the cabinet 20 for this very purpose.

From FIGS. 2 and 3 it will be seen that the outer casing of the cabinet 20 flares outward slightly towards the rear of the cabinet. The vertical walls or dividers 23 extend only part of the way to the back edge of the cabinet. Multiple cabinets 20 can thus be partially nested at the retail outlet and for shipping.

Figure 4:
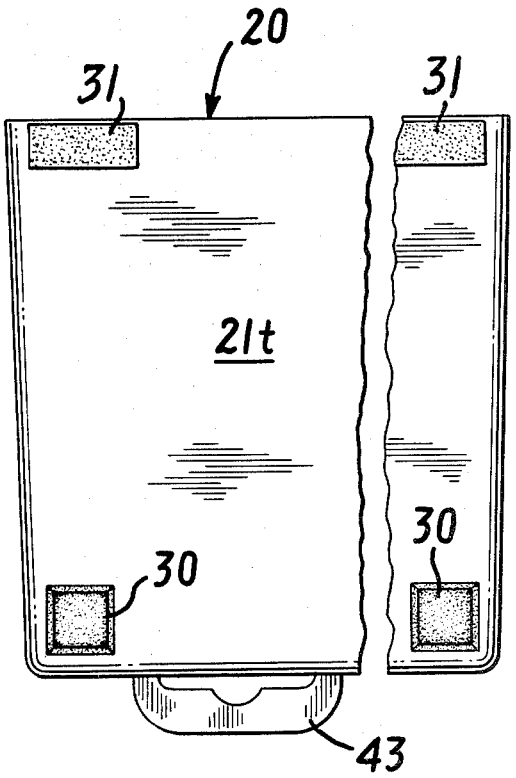
FIG. 4 is a top plan view of the storage system of FIG. 1 and shows projections adhesively affixed on the upper surface of the cabinet to facilitate stacking.
Figure 5:
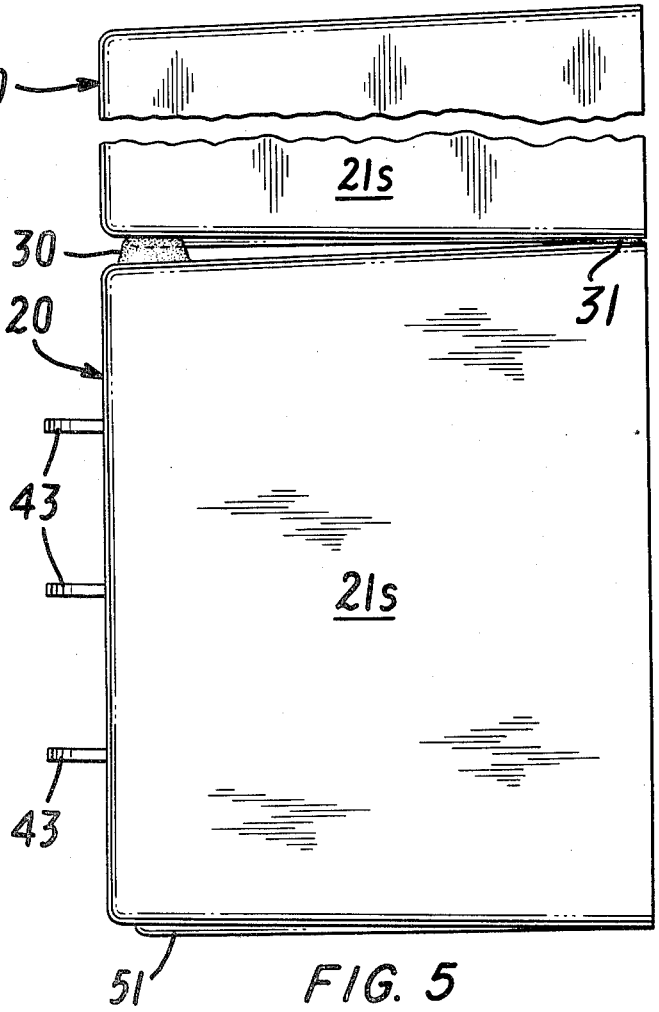
FIG. 5 is a side elevational view of stacked cabinets.
Figure 6:
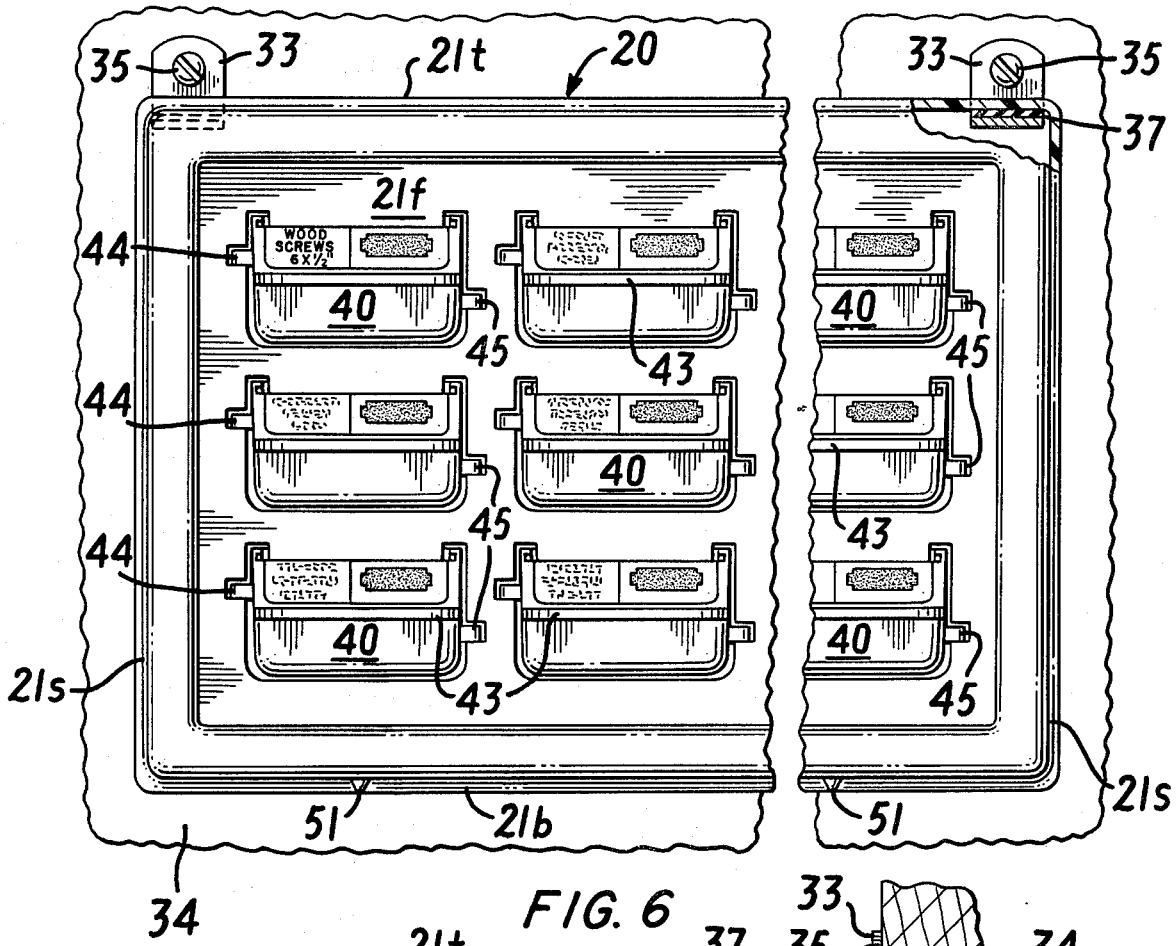
FIG. 6 is a front elevational view with parts broken away for clarity and illustrating a wall-mounted system with wall mounting brackets adhesively secured to the interior of the cabinet.
Figure 7:
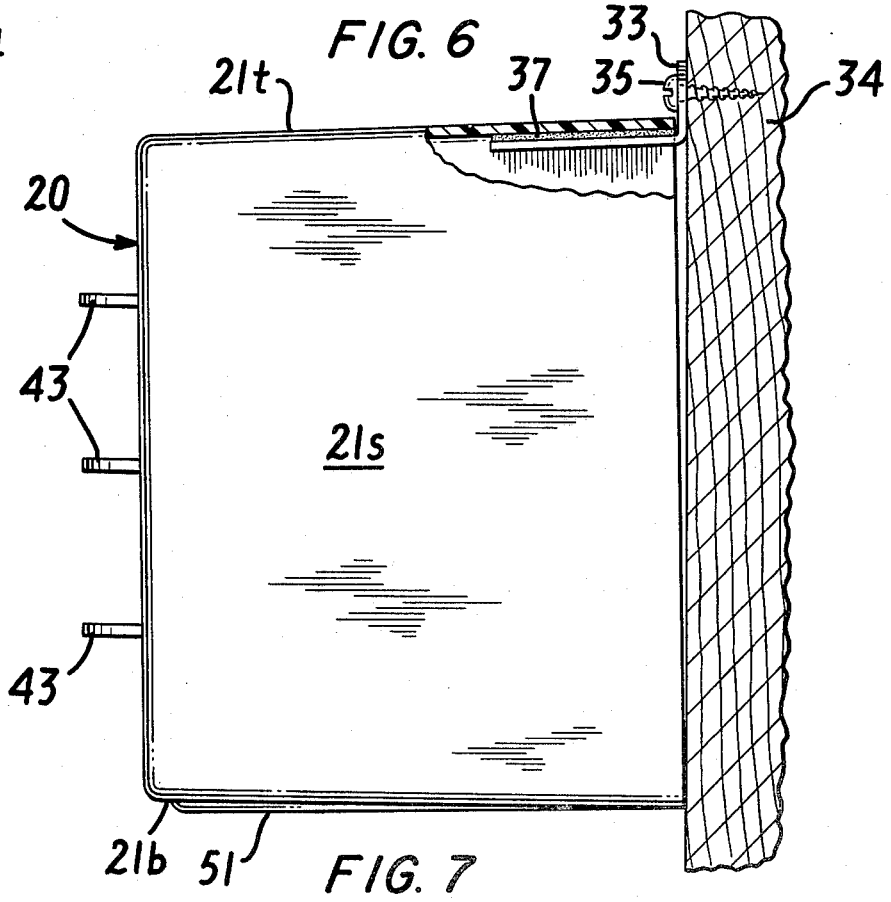
FIG. 7 is a side elevational view of the wall-mounted system of FIG. 5 with parts broken away for clarity and illustrating the wall mounting bracket and its adhesive connection to the cabinet interior.

Turning to FIGS. 4 and 5, if more than one cabinet 20 is needed by the purchaser, the cabinets can be stacked. For this purpose, a pair of spacers 30, adhesively securable to the top of the lower cabinet, is supplied with each cabinet to retain one on the other and to accommodate the slight flaring outward in the rearward direction mentioned just above. Adhesive strips 31 secure upper and lower stacked cabinets together. A pair of integrally formed ridges 51 on the bottom of the cabinets compensates for the flaring there to provide the surfaces on which the cabinets rest. For mounting a cabinet 20 on a wall or upright 34, as illustrated in FIGS. 7 and 6, a pair of angle brackets 33 is supplied for use with, for example, screws 35. Adhesive strips 37 are supplied, as well, to permit attachment of the brackets 33 to the interior of the cabinet 20. The adhesive strips 21 and 37, like the adhesive on the bottom of the spacers 30, can be of the well-known kind that ordinarily employ tear-away strips to reveal the adhesive coating.

In a further embodiment, a system 60 illustrated in FIGS. 10 to 13, a cabinet 61, has just six openings 62 that conform to the periphery of larger boxes 70. The cabinet 61 can be of the same outer dimensions as the cabinet 20 of FIGS. 1 to 5, and can, if desired be stacked with one or more cabinets 20 or wall-mounted in the manner of FIGS. 6 and 7. The further embodiment of FIGS. 10 to 13 allows the manufacturer to package larger numbers of those items that often are purchased in greater numbers.

The boxes 70 are supported in the cabinet 61, by flanges 74 and 75. Cooperating slots in vertical dividers receive the flanges and the flanges and slots again act as the keying means that both supports the boxes in place as drawers and prevents the use of other than the appropriate boxes in their place. Once more horizontal dividers or floors are omitted so that the cabinet is not capable of supporting other than the appropriate boxes.

Figure 9:
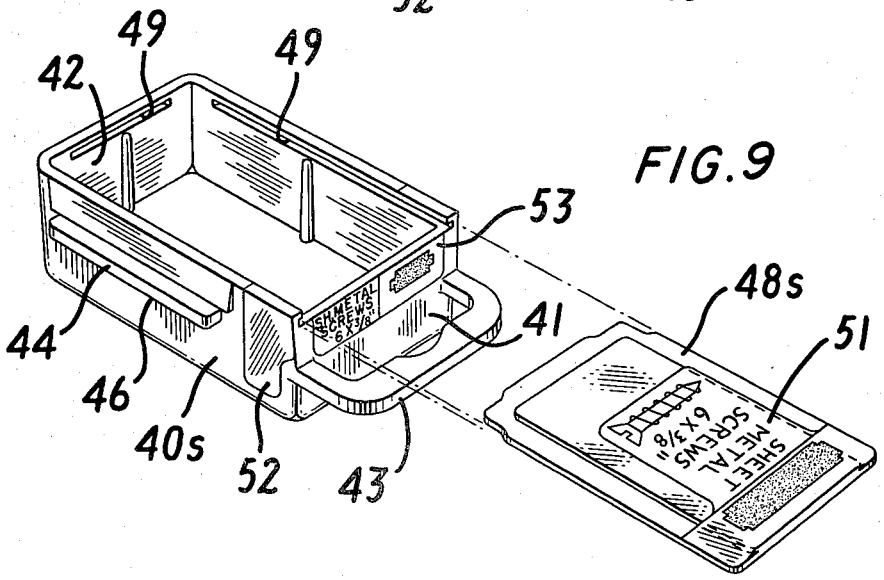
FIG. 9 is a further prospective view of a box as shown in FIG. 8 with its transparent lid removed and a portion of the label retained on the box front.
Figure 13:
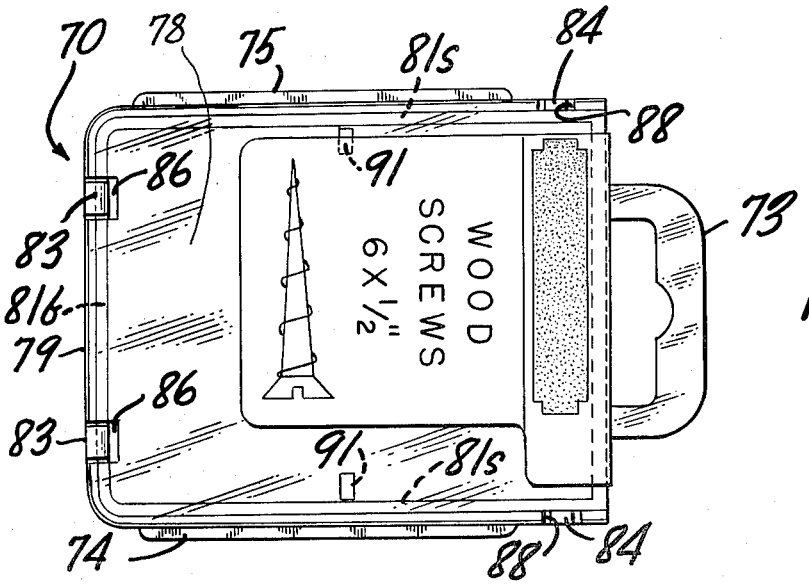
FIGS. 11, 12 and 13 are front elevation, side elevation and top plan views of boxes that form the larger drawers of the embodiment of FIG. 10.
Figure 11:
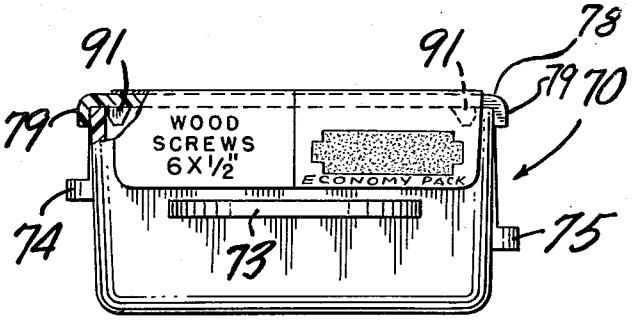
Figure 12:
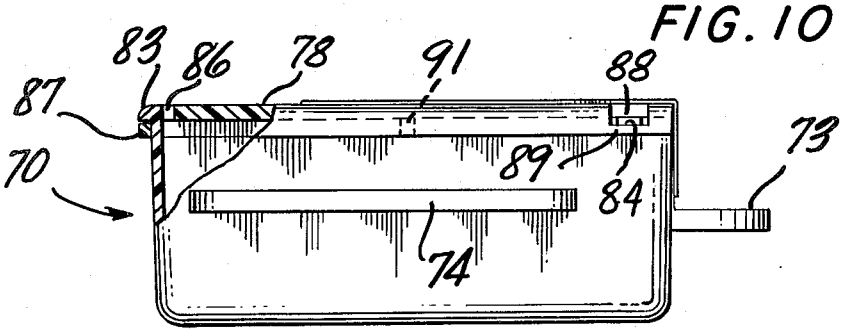

In addition to their large size, the boxes 70 differ from the boxes of FIGS. 8 and 9. As seen in FIGS. 11, 12 and 13, the box 70 has a transparent cover or lid 78. Three down turned edges 79 on the lid fit out and over three upper edges **81*b* and 81*s*, of the box back and side walls. These edges 79** give external support to the side walls of the box. The box can thus hold a relatively large number of small, heavy hardware items, for example, without the side walls bulging.

Front and side interlocks at the lid sides and back include a pair of projections or tabs 83 integrally formed on the upper back edge **81*b* and a pair of projections or tabs 84 integrally formed on upper side edges 81*s*. Openings 86 in the lid receive the tabs 83, which engage a section 87 of the down turned edge 79 to latch the cover on the back of the box. At the side of lid 78, openings 88 receive the tabs 84. The tabs 84 engage sections 89** to latch the cover to the box at its front.

The box 70 is provided with a tab 73 that can support the box on a display rack and later serve as a handle in the drawer and cabinet system. Finally a pair of integral internal stops 91, formed on the internal face of the cover, prevents the box sides from being pushed inward.

The box and cover shown in FIGS. 11 to 13 and their interlock details are designed for ease of molding. The cover and box provisions avoid unnecessary complication of the injection mold and provide good moldability of the parts. This avoids more expensive molds and favors more rapid molding cycle time with less molding rejections. The box and cover can cost less and require less expensive molds. The interlock provisions on cover and box require no removable mold parts complicating the molding procedure. The covers and boxes can come free of the mold without the withdrawal of mold parts such as sliding pins. The boxes are easily filled because the covers separate completely. The covers then easily snap into place on the boxes during factory packing operations.

Figure 10:
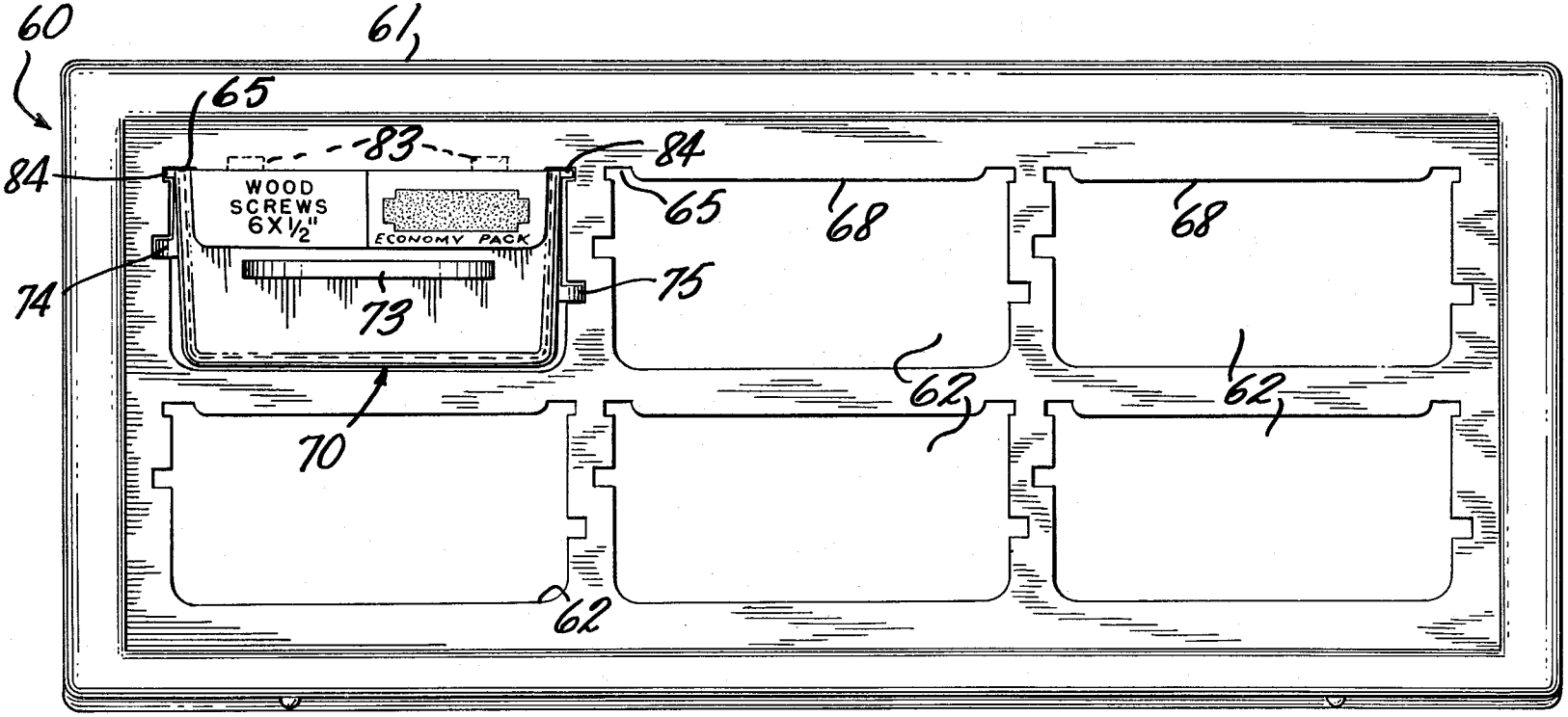
FIG. 10 is a front elevational view of another embodiment of the storage system arranged to house fewer, but larger drawers of somewhat different construction.

The cabinet 61 for the larger boxes is very much like that described in relation to the embodiment of FIGS. 1 to 9 so that lengthy repeated disclosure is not necessary. As seen in FIG. 10, the openings 62 include small notches 65 that accommodate the tabs 84 on the side of the box, and a tab 68 acts as a stop in the manner of the tab 28 discussed above.

The storage systems 10 provide inexpensively formed, easy to use, and highly utilitarian storage systems suitable wherever parts should be easily accessible, as in the machine shop, home workshop, or the like. Although specific details of preferred embodiments have been described above, it will be recognized that modifications and departures from those embodiments can be made without departure from the spirit and scope of the invention as defined in the appended claims.

The mating flanges and slots that form the keys and keyways on the boxes and cabinets of the foregoing embodiments can be located at various heights to serve as codes for the kinds of items therein. Like items can be packaged in like boxes, their flanges located at a particular, characteristic height. A cabinet whose slots receive flanges at that height, then, will accept and retain only boxes that contain the like items. For example, all machine screw boxes can have their flanges located differently from, say, those for wood screws. A cabinet that receives machine screw boxes will, then, not accept and retain the differently flanged wood screw boxes, and a very orderly system of multiple cabinets can be achieved, each cabinet containing only related items. Even a single cabinet can be arranged to receive particular boxes at particular locations, by using differing slot heights at some or all drawer sites. These principles apply, not just to hardware items, but to a wide variety of goods sold in small containers, as diverse as medicines, spices, and fishing supplies.

We claim:

1. A combination cabinet and drawers to be combined as a storage system, the combination including a cabinet having multiple drawer receiving openings in a face thereof, and multiple drawers, said drawers being boxes, keying means cooperating between the cabinet and the drawers for permitting insertion of only correctly keyed drawers into the cabinet for use therein.

2. The cabinet and drawers according to claim 1 wherein the keying means includes a flange on each side wall of each drawer, and slots for receiving the flanges on partitions in the cabinet, the flange on one side wall of each drawer being higher than the remaining flanges on the other side wall of the drawer, the slots being located to receive the flanges and to support the drawers for sliding movement open and shut.

3. The cabinet and drawers according to claim 2 wherein each of said partitions defines a first series of slots for a vertical row of drawers on one side of the partition and a second series of slots opening from the other side of the partition at different heights from the first series for a vertical row of drawers on the other side of the partition.

4. The drawer and cabinet combination according to claim 1, wherein the keying means are engageable between the cabinet and the drawers to support the drawers for sliding movement open and shut, and the cabinet being free of horizontal partitions, whereby drawers lacking the keying means are not supported in the cabinet.

5. The cabinet and drawers according to claim 1, including a tab at the front of each drawer receiving opening in the cabinet, the tab being engageable with an inside surface of a front wall of a drawer to limit movement of the drawer into the cabinet.

6. The cabinet and drawers according to claim 5, wherein the cabinet includes stacking means including a slip-resistant projection for a surface of the cabinet to engage another cabinet in stacked relation thereto.

7. The cabinet and drawers according to claim 5, further including mounting means for supporting the cabinet on an upright structure, and means for adhesively securing the mounting means to the cabinet.

8. A storage system cabinet for use with multiple drawers that are boxes in which parts are packaged and sold and each of which has first keying support means thereon; the cabinet including outer walls forming the outer surfaces of the cabinet, plural vertical dividers separating plural vertical rows of drawer sites, second keying support means on said dividers for accepting only boxes with cooperatively formed first keying support means, the second keying support means on the dividers defining supporting surfaces adapted to hold the drawers for sliding movement, and the cabinet being free of horizontal dividers capable of supporting the drawers.

9. The cabinet according to claim 8, wherein the second keying support means defines one of the supporting surfaces at one vertical location on one side of a drawer site and defines another supporting surface at a different height on the other side of that drawer site so as to cooperate only with drawers having cooperating surfaces at unequal heights.

10. The cabinet according to claim 9, wherein the second keying support means comprises slots on each side of a drawer site at unequal heights to cooperate with flanges on the drawers.

11. A box for packaging and selling parts and for use with a cooperating cabinet as drawers in a storage system, the box including first keying support means formed on sides thereof for engagement with second keying support means formed on the cabinet, said first keying support means defining supporting surfaces on the sides of the box adapted to engage surfaces on the cabinet to hold the box for sliding movement in the cabinet, the sides of the box that have said supporting surfaces differing in structural features forming a part of the first keying support means so as to cooperate with similarly differing features forming the second keying support of the cabinet.

12. The box according to claim 11 wherein the structural features by which the sides of the box differ are the heights at which said supporting surfaces are located on the sides of the box.

13. The box according to claim 12 wherein the first keying support means comprises first and second longitudinally extending flanges on the sides of the box, the flanges being located at different heights on the box sides to key the box to cooperatively positioned slots at each drawer site in the cabinet.

14. The box according to claim 13 including a label having a first portion thereof affixed to the lid of the box and a second portion thereof extending onto and affixed to a face of the box, whereby upon removal of the lid the second portion of the label remains on said face to identify the contents of the box when the box is used as a drawer in the cabinet.

15. The box according to claim 13 including a lid with down turned edges structurally reinforcing the box walls and cooperating interlock means on the box walls and the lid adapted to snap together and secure the lid to the body of the box.

16. The cabinet and drawers according to claim 1 wherein the keying means have one or more coding characteristics representative of the type of goods to be contained therein.

* * * * *